US007712463B2

(12) United States Patent
Quinn et al.

(10) Patent No.: US 7,712,463 B2
(45) Date of Patent: May 11, 2010

(54) SELF-REGULATING VALVE ASSEMBLY

(75) Inventors: Michael Quinn, East Hanover, NJ (US); Kerry Johnson, Madison, NJ (US)

(73) Assignee: KEE Action Sports I LLC, Sewell, NJ (US)

( * ) Notice: Subject to any disclaimer, the term of this patent is extended or adjusted under 35 U.S.C. 154(b) by 0 days.

(21) Appl. No.: 11/754,032

(22) Filed: May 25, 2007

(65) Prior Publication Data

US 2008/0078971 A1 Apr. 3, 2008

Related U.S. Application Data

(60) Provisional application No. 60/808,301, filed on May 25, 2006.

(51) Int. Cl.
*F41B 11/32* (2006.01)

(52) U.S. Cl. ..... 124/73; 124/71; 124/72; 124/74; 124/75; 124/76; 124/77

(58) Field of Classification Search ..... 124/71–77
See application file for complete search history.

(56) References Cited

U.S. PATENT DOCUMENTS

| | | | |
|---|---|---|---|
| 645,932 | A | 3/1900 | Beck et al. |
| 1,191,877 | A | 7/1916 | Dickey |
| 1,403,689 | A | 1/1922 | Hyndman |
| 1,403,719 | A | 1/1922 | Szepe |
| 1,404,689 | A | 1/1922 | Fairweather |
| 1,441,975 | A | 1/1923 | Edelin |

(Continued)

FOREIGN PATENT DOCUMENTS

| | | |
|---|---|---|
| DE | 3721527 | 1/1989 |

(Continued)

OTHER PUBLICATIONS

Tippmann Pneumatics, Inc 98 Custom Owner's Manual CO2 Powered Paintball Gun.

(Continued)

*Primary Examiner*—Bret Hayes
*Assistant Examiner*—Michael D David
(74) *Attorney, Agent, or Firm*—Volpe and Koenig, P.C.

(57) ABSTRACT

A self-regulating valve assembly for a compressed gas gun includes a valve housing and a valve body disposed within the valve housing. The rearward end of the valve body defined an outlet port. The forward end of the valve body defines a gas balance reservoir open to and in communication with the breech of the gun. A valve gas passage is provided between the valve body and the valve housing, the valve gas passage providing communication between the outlet port of the valve body and the gas balance reservoir of the valve body. A slidable valve poppet is disposed within the valve body and includes a sensing end adjacent to and at least partially within the gas balance reservoir, the sensing end having a sensing face adapted to react to gas pressure within the gas balance reservoir. The valve poppet is slidable between a closed position and an open position. A valve spring within the valve body biases the valve poppet toward the closed position. Pressure in the gas balance reservoir exerts a force on the sensing face to urge the valve poppet toward the closed position.

10 Claims, 7 Drawing Sheets

U.S. PATENT DOCUMENTS

| | | | | |
|---|---|---|---|---|
| 1,503,913 | A | 8/1924 | Miles | |
| 1,743,576 | A | 1/1930 | Bigham | |
| 1,862,697 | A | 6/1932 | Mihalyi | |
| 1,867,513 | A | 7/1932 | Johannes | |
| 2,123,324 | A | 7/1938 | Webby | |
| 2,283,300 | A | 5/1942 | Vincent | |
| 2,307,015 | A | 1/1943 | Boynton | |
| 2,357,951 | A | 9/1944 | Hale | |
| 2,398,263 | A | 4/1946 | Trimbach | |
| 2,450,029 | A | 9/1948 | Wells | |
| 2,499,340 | A | 2/1950 | Wells | |
| 2,550,887 | A | 5/1951 | Tratsch | |
| 2,594,240 | A | 4/1952 | Wells | |
| 2,618,254 | A | 11/1952 | Wells | |
| 2,635,599 | A | 4/1953 | Wells | |
| 2,811,150 | A | 10/1957 | Marocchi | |
| 2,817,328 | A | 12/1957 | Gale | |
| 2,881,752 | A | 4/1959 | Blahnik | |
| 3,103,212 | A | 9/1963 | Merz | |
| 3,204,625 | A | 9/1965 | Shepherd | |
| 3,248,008 | A | 4/1966 | Meierjohan | |
| 3,467,073 | A | 9/1969 | Rhodes | |
| 3,572,310 | A | 3/1971 | Chiba | |
| 3,610,223 | A | 10/1971 | Green | |
| 3,612,026 | A | 10/1971 | Vadas | |
| 3,628,557 | A | 12/1971 | Newborough | |
| 3,693,654 | A | 9/1972 | Runkle | |
| 3,695,246 | A | 10/1972 | Filippi et al. | |
| 3,741,189 | A | 6/1973 | Kester et al. | |
| 3,788,298 | A | 1/1974 | Hale | |
| 3,844,267 | A | 10/1974 | Mohr | |
| 3,855,988 | A | 12/1974 | Sweeton | |
| 3,867,921 | A | 2/1975 | Politzer | |
| 3,888,159 | A | 6/1975 | Elmore et al. | |
| 3,951,038 | A | 4/1976 | Van Langenhoven | |
| 4,004,566 | A | 1/1977 | Fischer | |
| 4,027,646 | A | 6/1977 | Sweeton | |
| 4,128,209 | A | 12/1978 | Johnson | |
| 4,185,824 | A | 1/1980 | Natwick | |
| 4,207,857 | A | 6/1980 | Balka, Jr. | |
| 4,304,213 | A | 12/1981 | Jereckos | |
| 4,332,097 | A | 6/1982 | Yatlor, Jr. | |
| 4,362,145 | A | 12/1982 | Stelcher | |
| 4,411,189 | A | 10/1983 | Miller | |
| 4,531,503 | A | 7/1985 | Shepherd | |
| 4,616,622 | A | 10/1986 | Milliman | |
| 4,646,709 | A | 3/1987 | Kholin | |
| 4,770,153 | A | 9/1988 | Edelman | |
| 4,819,609 | A | 4/1989 | Tippmann | |
| 4,819,610 | A | 4/1989 | Lacam et al. | |
| 4,896,646 | A | 1/1990 | Kahelin et al. | |
| 4,926,742 | A | 5/1990 | Ma et al. | |
| 4,930,400 | A | 6/1990 | Brandl et al. | |
| 4,936,282 | A | 6/1990 | Dobbins et al. | |
| 4,951,548 | A | 8/1990 | Wixon et al. | |
| 4,951,644 | A | 8/1990 | Bon | |
| 4,965,951 | A | 10/1990 | Miller et al. | |
| 4,986,251 | A | 1/1991 | Lilley | |
| 4,993,400 | A | 2/1991 | Fitzwater | |
| 5,062,454 | A | 11/1991 | Ichihashi et al. | |
| 5,063,905 | A | 11/1991 | Farrell | |
| 5,097,816 | A | 3/1992 | Miller | |
| 5,097,985 | A | 3/1992 | Jones | |
| 5,166,457 | A | 11/1992 | Lorenzetti | |
| 5,257,614 | A | 11/1993 | Sullivan | |
| 5,280,778 | A | 1/1994 | Kotsiopoulos | |
| 5,282,454 | A | 2/1994 | Bell et al. | |
| 5,333,594 | A | 8/1994 | Robinson | |
| 5,335,579 | A | 8/1994 | David | |
| 5,337,655 | A | 8/1994 | Bielfeldt | |
| 5,339,791 | A | 8/1994 | Sullivan | |
| 5,349,939 | A | 9/1994 | Perrone | |
| 5,353,712 | A | 10/1994 | Olson | |
| 5,383,442 | A | 1/1995 | Tippmann | |
| 5,456,153 | A | 10/1995 | Bentley et al. | |
| 5,490,493 | A | 2/1996 | Salansky | |
| 5,494,024 | A | 2/1996 | Scott | |
| 5,497,758 | A | 3/1996 | Dobbins et al. | |
| 5,503,137 | A | 4/1996 | Fusco | |
| 5,505,188 | A | 4/1996 | Williams | |
| 5,511,333 | A | 4/1996 | Farrell | |
| 5,515,838 | A | 5/1996 | Anderson | |
| 5,520,171 | A | 5/1996 | David | |
| 5,542,570 | A | 8/1996 | Nottingham et al. | |
| 5,561,258 | A | 10/1996 | Bentley et al. | |
| 5,598,871 | A | 2/1997 | Sturman et al. | |
| 5,600,083 | A | 2/1997 | Bentley et al. | |
| 5,613,483 | A | 3/1997 | Lukas et al. | |
| 5,669,369 | A | 9/1997 | Scott | |
| 5,704,342 | A | 1/1998 | Gibson et al. | |
| 5,722,383 | A | 3/1998 | Tippmann | |
| 5,727,538 | A | 3/1998 | Ellis | |
| 5,736,720 | A | 4/1998 | Bell et al. | |
| 5,749,797 | A | 5/1998 | Sunseri et al. | |
| 5,769,066 | A | 6/1998 | Schneider | |
| 5,771,875 | A | 6/1998 | Sullivan | |
| 5,784,985 | A | 7/1998 | Lodico et al. | |
| 5,791,325 | A | 8/1998 | Anderson | |
| 5,794,606 | A | 8/1998 | Deak | |
| 5,809,983 | A | 9/1998 | Stoneking | |
| 5,816,232 | A | 10/1998 | Bell | |
| 5,839,422 | A | 11/1998 | Ferris | |
| 5,878,736 | A | 3/1999 | Lotuaco, III | |
| 5,881,962 | A | 3/1999 | Schmidt et al. | |
| 5,887,578 | A | 3/1999 | Backeris et al. | |
| 5,913,303 | A | 6/1999 | Kotsiopoulos | |
| 5,947,100 | A | 9/1999 | Anderson | |
| 5,954,042 | A | 9/1999 | Harvey | |
| 5,957,119 | A | 9/1999 | Perry | |
| 6,003,547 | A | 12/1999 | Tippmann, Jr. | |
| 6,024,077 | A | 2/2000 | Kotsiopoulos | |
| 6,032,395 | A | 3/2000 | Bentley et al. | |
| 6,055,975 | A | 5/2000 | Gallagher et al. | |
| 6,065,460 | A * | 5/2000 | Lotuaco, III | 124/72 |
| 6,109,252 | A | 8/2000 | Stevens | |
| 6,138,656 | A | 10/2000 | Rice et al. | |
| 6,206,562 | B1 | 3/2001 | Eyraud et al. | |
| 6,213,110 | B1 | 4/2001 | Christopher et al. | |
| 6,220,237 | B1 | 4/2001 | Johnson et al. | |
| 6,305,367 | B1 | 10/2001 | Kotsiopoulos | |
| 6,327,953 | B1 | 12/2001 | Andresen | |
| 6,343,599 | B1 * | 2/2002 | Perrone | 124/73 |
| 6,347,621 | B1 | 2/2002 | Guthrie | |
| 6,360,736 | B1 | 3/2002 | Juan | |
| 6,374,819 | B1 | 4/2002 | Ming-Hsien | |
| 6,408,837 | B1 | 6/2002 | Johnson et al. | |
| D459,767 | S | 7/2002 | Rushton | |
| 6,415,781 | B1 | 7/2002 | Perrone | |
| 6,418,919 | B1 | 7/2002 | Perrone | |
| 6,425,781 | B1 | 7/2002 | Bernstein et al. | |
| 6,460,530 | B1 | 10/2002 | Backeris et al. | |
| 6,467,473 | B1 | 10/2002 | Kotsiopoulos | |
| 6,468,879 | B1 | 10/2002 | Lamure et al. | |
| 6,474,326 | B1 | 11/2002 | Smith et al. | |
| 6,481,432 | B2 | 11/2002 | Rushton et al. | |
| 6,488,019 | B2 | 12/2002 | Kotsiopoulos | |
| 6,502,567 | B1 | 1/2003 | Christopher et al. | |
| 6,526,955 | B1 | 3/2003 | Juan | |
| 6,550,468 | B1 | 4/2003 | Tippmann, Jr. | |
| 6,557,542 | B1 | 5/2003 | Orr | |
| 6,561,176 | B1 | 5/2003 | Fujimoto et al. | |
| 6,591,824 | B2 | 7/2003 | Hatcher | |
| 6,601,780 | B1 * | 8/2003 | Sheng | 239/337 |
| 6,609,511 | B2 | 8/2003 | Kotsiopoulos | |

| | | | | |
|---|---|---|---|---|
| 6,615,814 | B1 | 9/2003 | Rice et al. | |
| 6,637,420 | B2 * | 10/2003 | Moritz | 124/73 |
| 6,637,421 | B2 | 10/2003 | Smith et al. | |
| 6,644,293 | B2 | 11/2003 | Jong | |
| 6,644,295 | B2 | 11/2003 | Jones | |
| 6,658,982 | B2 | 12/2003 | Cherry | |
| 6,684,873 | B1 | 2/2004 | Anderson | |
| 6,701,907 | B2 | 3/2004 | Christopher et al. | |
| 6,708,685 | B2 | 3/2004 | Masse | |
| 6,725,852 | B1 | 4/2004 | Yokota et al. | |
| 6,729,321 | B2 | 5/2004 | Ho | |
| 6,729,497 | B2 | 5/2004 | Rice et al. | |
| 6,732,726 | B2 | 5/2004 | Ho | |
| 6,739,322 | B2 | 5/2004 | Rice et al. | |
| 6,739,323 | B2 | 5/2004 | Tippmann, Jr. | |
| 6,742,512 | B1 | 6/2004 | Ho | |
| 6,752,137 | B2 | 6/2004 | Brunette | |
| 6,763,822 | B1 | 7/2004 | Styles | |
| 6,792,933 | B2 | 9/2004 | Christopher et al. | |
| 6,802,306 | B1 | 10/2004 | Rice | |
| 6,807,959 | B1 | 10/2004 | Murdock et al. | |
| 6,810,871 | B2 | 11/2004 | Jones | |
| 6,832,605 | B2 | 12/2004 | Farrell | |
| 6,860,258 | B2 | 3/2005 | Farrell | |
| 6,860,259 | B2 | 3/2005 | Rice et al. | |
| 6,889,680 | B2 | 5/2005 | Christopher et al. | |
| 6,889,681 | B1 * | 5/2005 | Alexander et al. | 124/72 |
| 6,889,682 | B2 * | 5/2005 | Styles et al. | 124/77 |
| 6,907,901 | B2 | 6/2005 | Holmes et al. | |
| 6,915,792 | B1 | 7/2005 | Sheng | |
| 6,978,776 | B2 | 12/2005 | Hamilton | |
| 6,981,493 | B1 | 1/2006 | Poteracku | |
| 7,017,569 | B2 | 3/2006 | Jong | |
| 7,021,302 | B2 | 4/2006 | Neumaster | |
| 7,069,922 | B1 * | 7/2006 | Orr | 124/73 |
| 7,077,118 | B2 | 7/2006 | Lewis | |
| 7,111,621 | B2 * | 9/2006 | Lin | 124/74 |
| 7,159,585 | B2 | 1/2007 | Quinn et al. | |
| 7,270,121 | B2 | 9/2007 | Lubben | |
| 2001/0042543 | A1 | 11/2001 | Perrone | |
| 2002/0002785 | A1 | 1/2002 | Tippmann, Jr. | |
| 2002/0059927 | A1 | 5/2002 | Woods | |
| 2002/0088449 | A1 | 7/2002 | Perrone | |
| 2002/0096164 | A1 | 7/2002 | Perrone | |
| 2003/0000511 | A1 * | 1/2003 | Moritz | 124/73 |
| 2003/0024520 | A1 | 2/2003 | Dobbins | |
| 2003/0024521 | A1 | 2/2003 | Smith et al. | |
| 2003/0047174 | A1 | 3/2003 | Tiberius et al. | |
| 2003/0047175 | A1 * | 3/2003 | Farrell | 124/76 |
| 2003/0474175 | | 3/2003 | Farrell | |
| 2003/0079731 | A1 | 5/2003 | Dobbins | |
| 2003/0226555 | A1 | 12/2003 | Reible | |
| 2004/0065310 | A1 | 4/2004 | Masse | |
| 2004/0084040 | A1 | 5/2004 | Jones | |
| 2004/0134476 | A1 | 7/2004 | Smith et al. | |
| 2004/0144012 | A1 | 7/2004 | Adams | |
| 2004/0211402 | A1 | 10/2004 | Christopher et al. | |
| 2004/0216728 | A1 | 11/2004 | Jong | |
| 2005/0115550 | A1 | 6/2005 | Jones | |
| 2005/0133014 | A1 | 6/2005 | Jones | |
| 2005/0268894 | A1 * | 12/2005 | Styles et al. | 124/74 |
| 2005/0274370 | A1 | 12/2005 | Lubben | |
| 2006/0005823 | A1 | 1/2006 | Quinn | |
| 2006/0011184 | A1 | 1/2006 | Jacobsson et al. | |
| 2006/0011185 | A1 | 1/2006 | Jacobsson et al. | |
| 2006/0037597 | A1 | 2/2006 | Wood | |
| 2006/0086347 | A1 | 4/2006 | Hedberg | |
| 2006/0124118 | A1 | 6/2006 | Dobbins | |
| 2006/0249131 | A1 | 11/2006 | Broersma | |
| 2006/0254572 | A1 | 11/2006 | Hall | |
| 2007/0101981 | A1 | 5/2007 | Chen | |
| 2007/0295320 | A1 | 12/2007 | Carnall et al. | |

FOREIGN PATENT DOCUMENTS

| | | | |
|---|---|---|---|
| DE | 4343870 | | 6/1994 |
| DE | 19922589 | | 12/2000 |
| EP | 01054228 | | 11/2000 |
| EP | 01653189 | | 5/2006 |
| GB | 2193797 | | 2/1988 |
| GB | 2228067 | | 8/1990 |
| GB | 2258913 | | 2/1993 |
| GB | 2322438 | | 8/1998 |
| JP | 61149676 | A | 7/1986 |
| JP | 02147876 | A | 10/1989 |
| JP | 03249485 | A | 11/1991 |
| JP | 2002317879 | A | 10/2002 |
| SU | 1384803 | A | 3/1988 |
| WO | 98/13660 | | 4/1998 |
| WO | 01/44745 | | 6/2001 |

OTHER PUBLICATIONS

Tippmann Pneumatics, Inc A-5 Owner's Manual CO2 Powered Paintball Marker.

Tippmann Pneumatics, Inc SL-68 II Owner's Manual CO2 Powered Paintball Marker.

* cited by examiner

SELF-REGULATING VALVE ASSEMBLY

CROSS REFERENCE TO RELATED APPLICATION

This application claims the benefit of U.S. Provisional Application No. 60/808,301, filed May 25, 2006, which is incorporated by reference as if fully set forth.

FIELD OF INVENTION

This invention relates to valves and valve assemblies. Namely, valves used in compressed gas guns.

BACKGROUND

Compressed gas guns, such as paintball markers used in the sport of paintball, using compressed gas or air for firing projectiles are well known. As used herein, the term "compressed gas gun" refers to any gun or similar launching mechanism for use in sport wherein a projectile is fired via the force of compressed gas, and includes paintball markers. As used herein, the term "projectiles" refers to both paintballs and other projectiles used in sport and game-play.

There are a few basic mechanisms employed in compressed gas guns for firing a projectile during a firing operation. A compressed gas gun generally includes an interior portion including passages for receiving the operating parts of the gun. These passages are often provided as generally cylindrical openings. Loading a projectile into the breech of a compressed gas gun involves a bolt having a bolt passage therethrough that reciprocates from a loading position, allowing a projectile into the breech to a firing position.

A valve system is employed to release compressed gas from a source of compressed gas to fire the projectile from the gun. The valve system generally utilizes a hammer or ram that moves under spring force or pneumatic force upon actuation of a trigger to strike the stem of a poppet or Nelson-style valve to allow compressed gas from a compressed gas chamber to flow through the valve body. The compressed gas flows through the opened valve body and through a passage in the bolt, thereby firing a projectile in the breech of the paintball marker from the chamber and down the barrel. While other types of valve systems are employed, generally, most involve directing compressed gas under pressure to fire a projectile from the compressed gas gun.

In many cases, compressed gas guns utilize a hammer, striker, or ram arrangement to actuate a poppet-type or valve as the firing valve, i.e., as the valve that releases compressed gas from a compressed gas source to fire a projectile from the gun. A prior art valve 10 is shown in a closed position in FIGS. 1A and 1B. This type of prior art valve, or a Nelson-style valve, or generally similar variations, have been used in paintball markers (guns) sold under, for example, the brand names INDIAN CREEK DESIGNS, TIPPMANN and BT. Similar valve arrangement, in various orientations, are shown in U.S. Pat. No. 4,936,282 and U.S. Pat. No. 5,257,614. A valve spring 14 is provided, biasing the seat 16 or cup seal of the valve 10 to a closed position. A stem or pin 24 that is attached to the seat 16 or cup seal extends out the rear end of the valve 10. In known compressed gas guns, a spring biased hammer 12 is provided, retained in a cocked or ready position by a sear 18 that pivots to engage a portion of the hammer 12. A schematic representation of such a compressed gas gun operation is shown in FIG. 1A and the valve is shown in greater detail in FIG. 1B. Actuation of a trigger 20 (such as by pulling) disengages the sear 18 from the hammer 12, allowing the hammer 12 to spring forward under the bias force of a hammer spring 22, to contact the stem 24 of the valve 10. When the hammer 12 contacts the stem 24, the seat 16 moves away from the valve body, opening the valve 10, and allowing compressed gas to flow through the opening in the valve body. These types of compressed gas guns move the hammer back to the loading or start position by "blow back," i.e., some of the air from a high pressure chamber returns the hammer to the cocked or loading position, thus "blowing" the hammer back to the starting position.

As can be appreciated, if pressure inside the valve body increases, there is more force pushing against the valve seat or cup seal. The compressed gas within the valve body exerts a force on the effective surface area of the seat or cup seal 16, which exerts a force toward the valve pin or stem 24, thereby tending to keep the valve closed. Thus, a greater force is needed to move the seat or cup seal away from the valve opening to actuate the valve. This mechanism has drawbacks. For example, it requires a heavy hammer propelled forward by a heavy hammer spring. A heavier hammer and hammer spring is needed to overcome the combined force of the compressed gas on the effective surface area of the valve seat or cup seal, combined with the biasing force of the valve spring. In turn, more energy is absorbed from the moving hammer when it hits the valve pin, and more force is required to open the valve. This reduces the amount of time the valve poppet is open.

As can be further appreciated, the force of the valve spring must be strong to return the seat of the poppet valve to a closed position. Moreover, the force of the hammer spring moving the hammer must be strong enough overcome the valve spring. This arrangement creates inefficiencies and wastes compressed gas.

Accordingly, there remains a need for a valve utilizing a lighter hammer and a lighter main spring in order to reduce the reciprocating mass inside the paintball marker, reduce the weight of the trigger pull, and reduce the force with which the marker chambers a paintball, all while maintaining a stable velocity over a wide range of input pressures.

SUMMARY

The present invention provides a self-regulating valve assembly. The self-regulating valve assembly includes a valve housing and a valve body disposed within the valve housing. The valve body defines am inlet port for receiving gas under pressure from a gas source and has a rearward end and a forward end. The rearward end defines an outlet port including a seat, and the forward end defines a gas balance reservoir in communication with a firing tube and breech of a compressed gas gun. A valve gas passage is defined between the valve body and the valve housing, the valve gas passage providing communication between the outlet port and the gas balance reservoir of the valve body. A valve poppet is disposed within the valve body and includes a sealing end for contact and sealing engagement with the seat of the valve body in a closed position of the self-regulating valve. The valve poppet further includes a sensing end adjacent the gas balance reservoir, at least a portion of the sensing end slidable within gas balance reservoir, the having a sensing face adapted to react to gas pressure communicated to the gas balance reservoir. The valve poppet is slidable between a closed position and an open position. A valve spring is disposed within the valve body, the valve spring biasing the valve poppet toward the closed position. An increase in pressure in the gas balance reservoir exerts a force on the sensing face of the valve poppet to urge the valve poppet toward the closed position.

The present invention further provides a gas gun having a gun body with a rearward end and a forward end. A hammer is disposed within the gun body adjacent the rearward end of the gun body, the hammer having a forward end. The hammer is slidable from a rearward position to a forward position, and the forward end of the hammer is adapted to contact a valve pin. A main spring is disposed within the gun body and biases the hammer toward the forward position. A bolt is disposed within the gun body adjacent the forward end of the gun body, the bolt being slidable from a rearward position to a forward position. A firing tube is partially disposed within the bolt. A self-regulating valve is disposed within the gun body between the hammer and the bolt. The self-regulating valve includes the valve pin extending rearward and the valve pin includes a contact end. A connecting rod connects the hammer and the bolt for synchronized movement between the hammer and the bolt. Release of the main spring urges the forward end of the hammer to its forward position to contact the contact end of the valve pin and shift the self-regulating valve from a closed position to an open position. The forward movement of the hammer causes synchronized forward movement of the bolt via the connecting rod.

DETAILED DESCRIPTION OF THE PREFERRED EMBODIMENTS

Figure 1A:
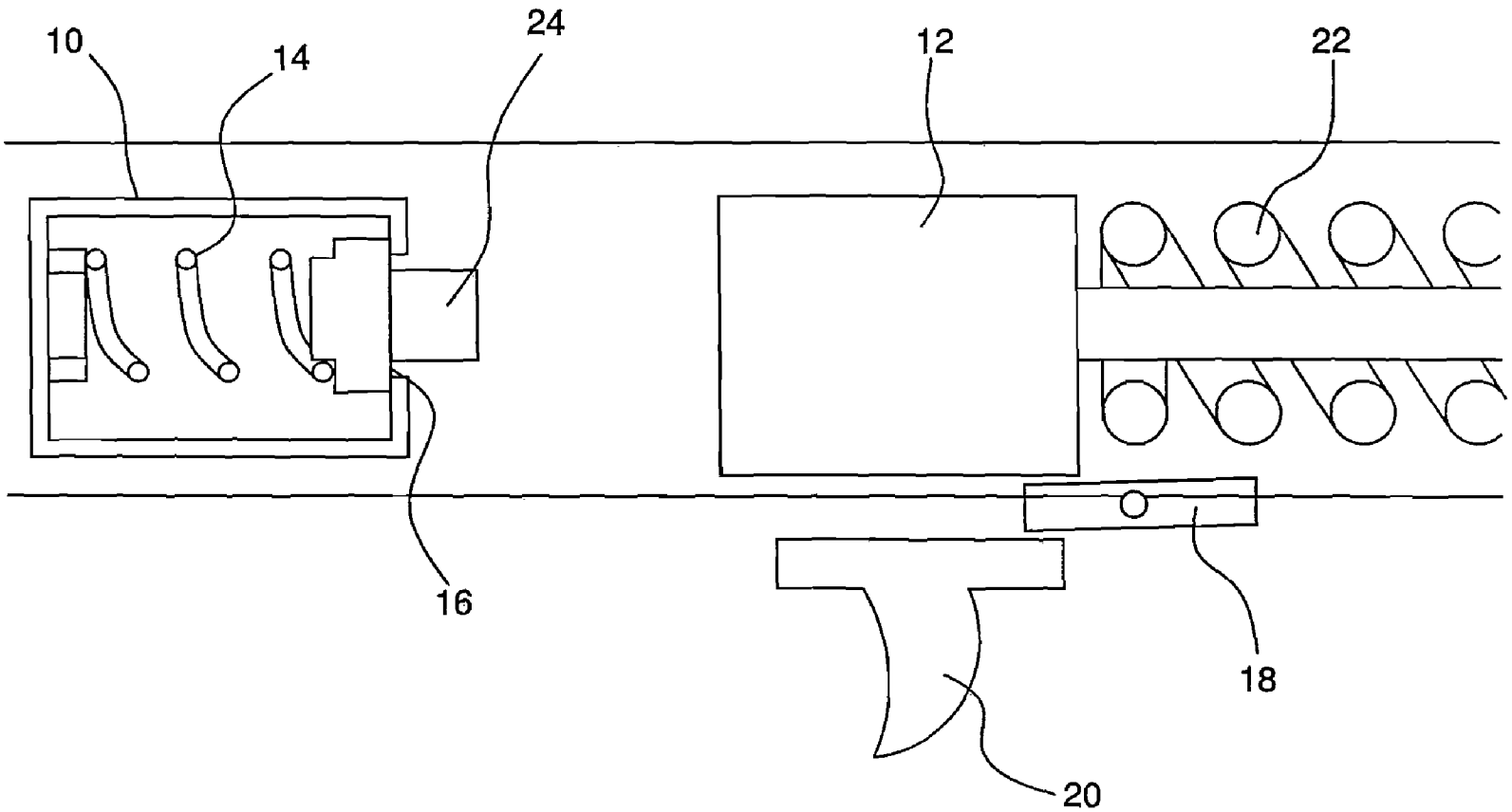
PRIOR ART FIG. 1A
FIGS. 1A and 1B are cross-sectional side views of a known poppet valve and hammer assembly, the assembly's forward end toward the left and its rearward end toward the right as viewed in the figures.
Figure 1B:
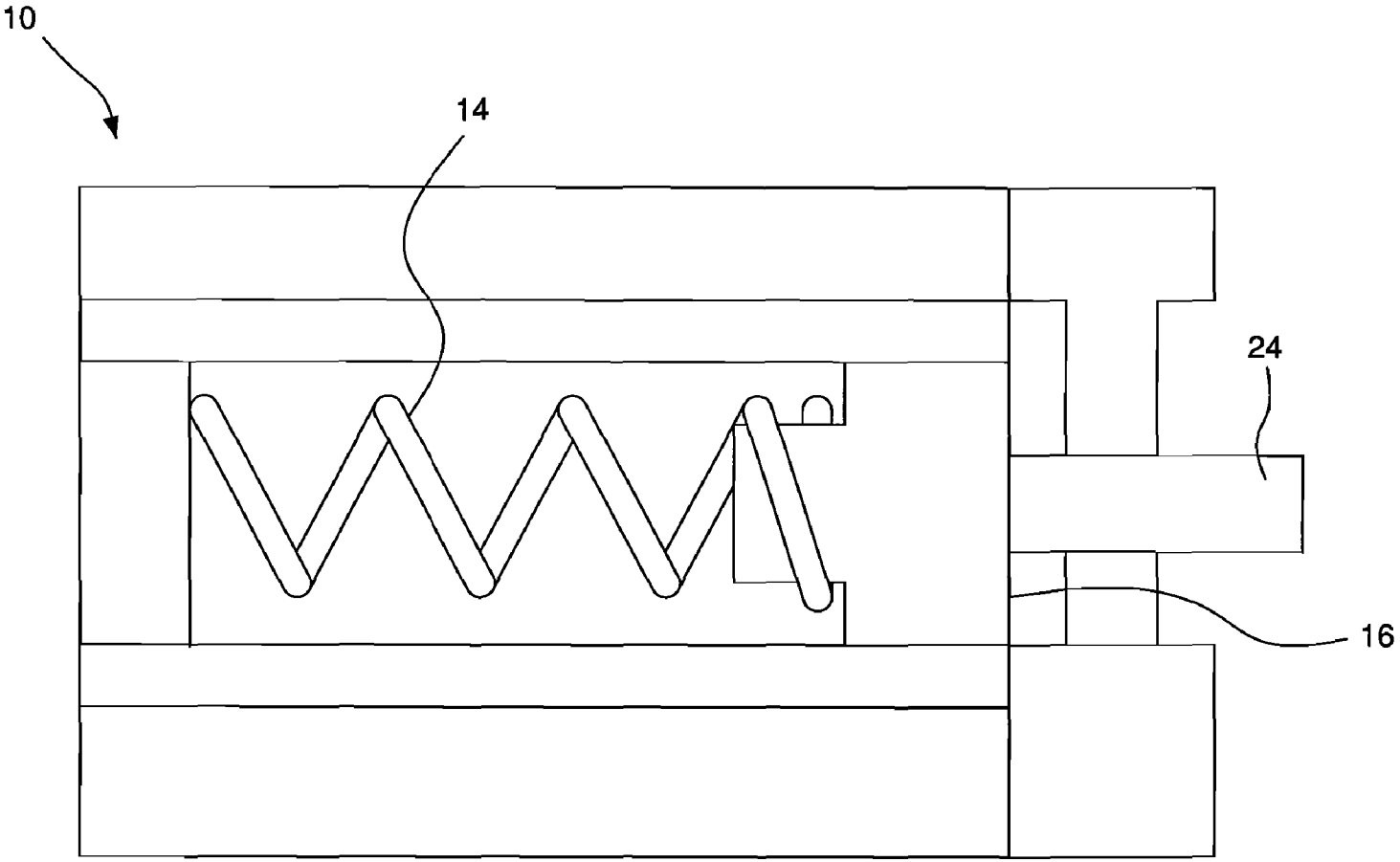
PRIOR ART FIG. 1B

For purposes of this detailed description, all reference to direction or orientation are from the perspective of a user firing a compressed gas gun by holding the gun upright in its normal firing position. For example, "rear" or "rearward" refers to a portion or portions closer to the user, and "forward" refers to a portion or portions farther away from the user (i.e., more toward the barrel than the grip, trigger, or hammer).

The preferred embodiments of the present invention are described below with reference to the drawing figures where like numerals represent like elements throughout.

Figure 2:
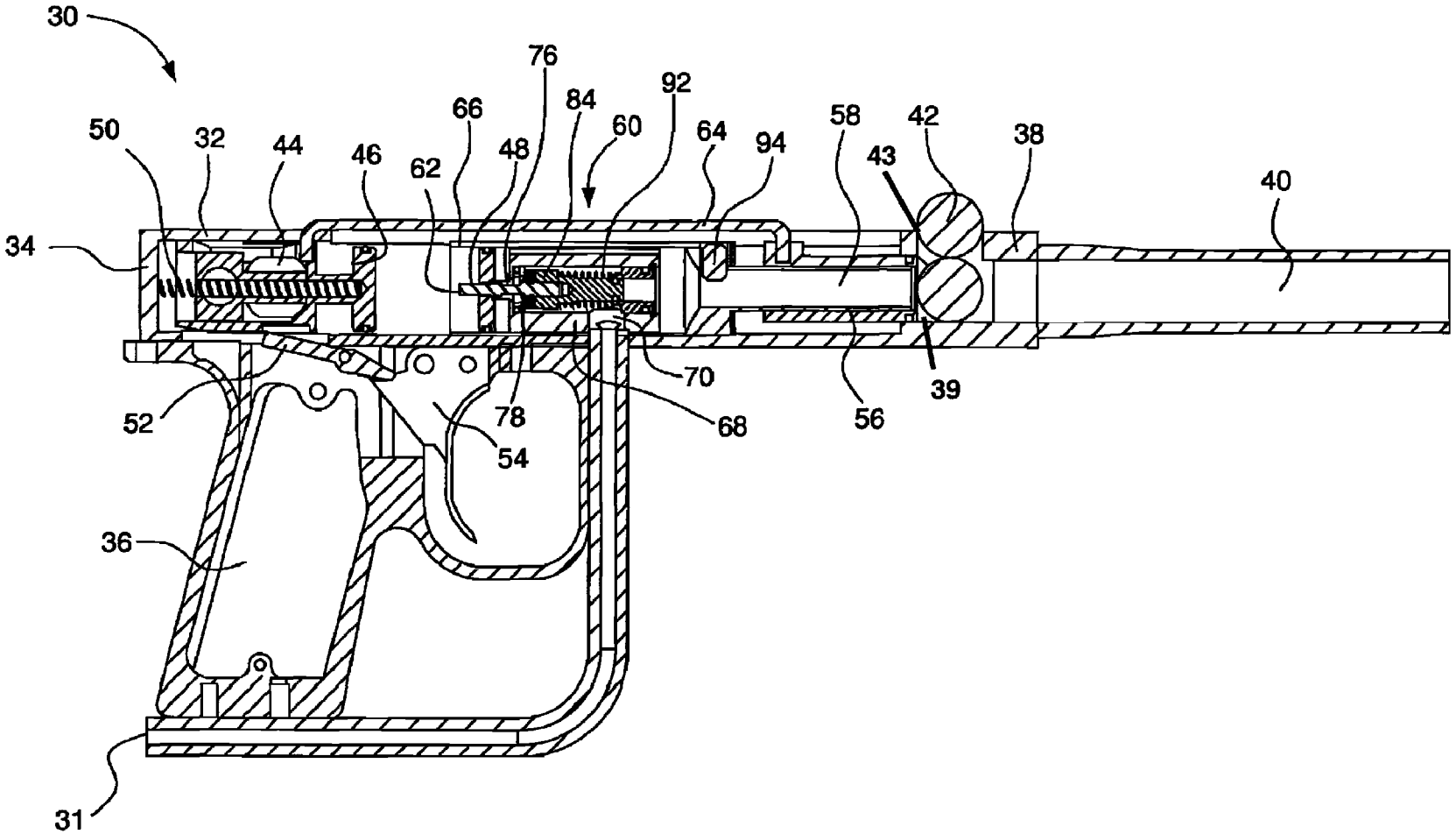
FIG. 2 is a cross-sectional side view an embodiment of a gas gun in a ready-to-fire position utilizing a self-regulating valve assembly in accordance with the present invention, the gas gun's rearward end toward the left and its forward end toward the right as viewed in the figure.
Figure 4:
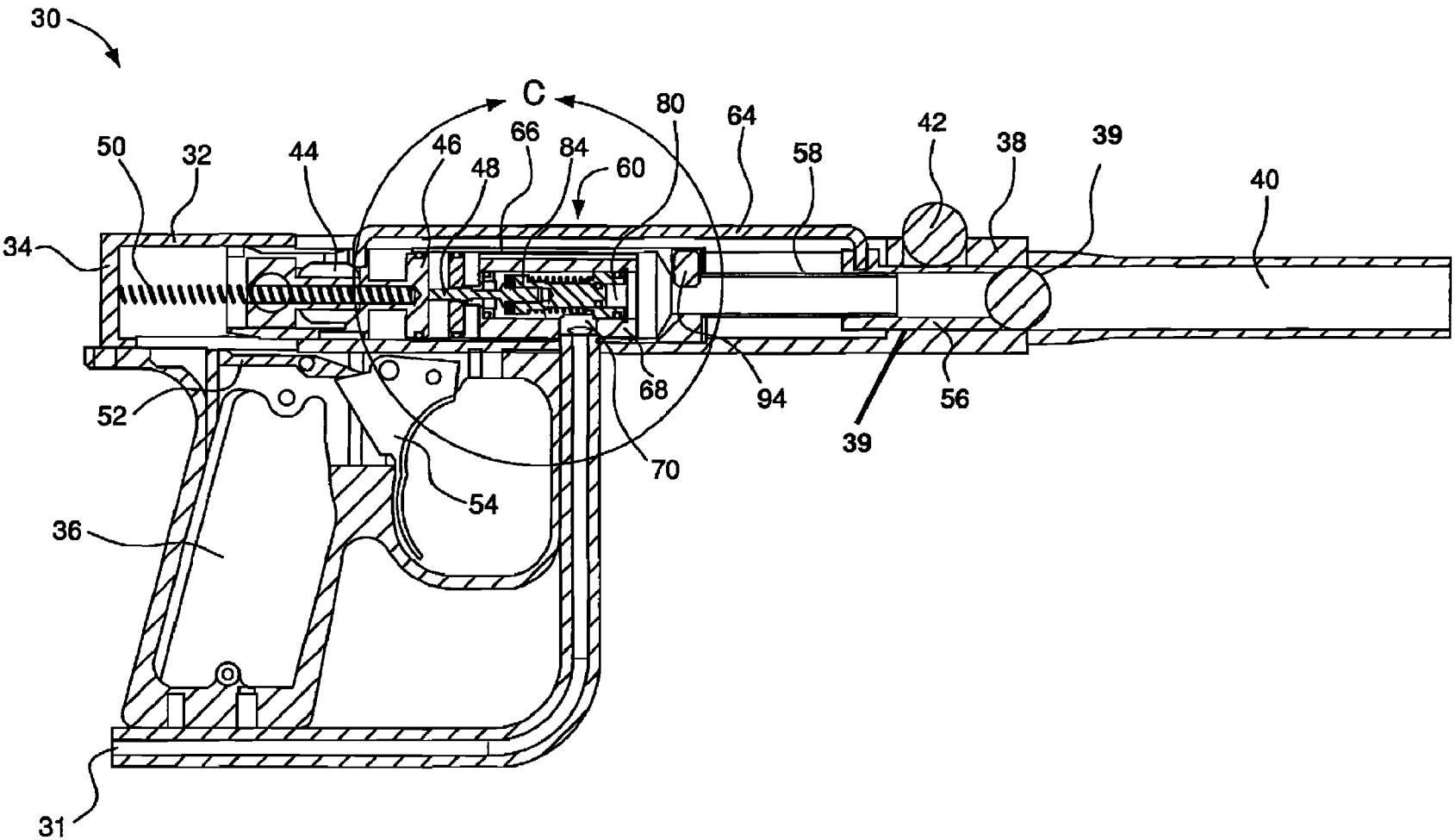
FIG. 4 is a cross-sectional side view the gas gun of FIG. 2 in a firing position.

Referring generally to FIGS. 2 and 4, a gas gun 30 having a gun body 32 with a rearward end 34 towards its grip 36 and a forward end 38 towards its barrel 40 is shown. The gun body 32 includes a generally cylindrical interior passage or space for receiving at least some of the firing components (e.g., the hammer and valving components) of the gun 30. FIG. 2 represents the gas gun 30 with the components in a ready-to-fire position, and FIG. 4 represents the gas gun 30 with the components in a firing position. Projectiles, such as paintballs 42, are also shown. The gun body 32 includes a feed inlet port 43 through which projectiles 42 feed into the breech 39 of the gun 30.

A hammer 44 (sometimes referred to in the art as a ram or striker) is disposed within the gun body 32 adjacent the rearward end 34 of the gun body 32, the hammer 44 having a forward end 46 facing the self-regulating valve 60 of the present invention. The forward end 46 of the hammer 44 is adapted to contact a valve pin 48 (also referred to as a stem), which will be described in greater detail below.

The hammer 44 is slidable from a rearward position (as shown in FIG. 2) to a forward position (as shown in FIG. 4). More specifically, a main hammer spring 50 is disposed within the gun body 32 and biases the hammer 44 toward the forward or firing position. The hammer 44 is retained in a cocked or ready position by a sear 52 that pivots to engage a portion of the hammer 44, as shown in FIG. 2. Actuation of a trigger 54 (such as by pulling the trigger) disengages the sear 52 from the hammer 44, allowing the hammer 44 to spring forward under the bias of the main hammer spring 50, as shown in FIG. 4. The main hammer spring 50 may be positioned to travel along a post or spring guide to maintain the main hammer spring 50 in position.

A bolt 56 is disposed within the gun body 32 and slidable within the breech 39 of the gun 30, preferably adjacent the forward end 38 of the gun body 32 adjacent the barrel 40, the bolt 56 being slidable from a rearward position (FIGS. 2 and 3) to a forward position (FIGS. 4 and 5) to open and close the breech 39 of the gun. A firing tube 58 is partially disposed within the bolt 56, such that the bolt 56 coaxially surrounds the firing tube 58.

The self-regulating valve 60 of the present invention is preferably disposed within the gun body 32 between the hammer 44 and the bolt 56. although, as discussed below, the valve 60 could be positioned in different orientations based on the arrangement of a particular compressed gas gun. The self-regulating valve 60 (described in greater detail below) includes the valve pin 48 extending rearward toward the hammer 44, the valve pin 48 including a contact end 62. A connecting rod 64 connects the hammer 44 and the bolt 56 for synchronized movement of the hammer 44 and the bolt 56. The connecting rod 64 provides a mechanical linkage between the hammer 44 and the bolt 56.

Figure 3:
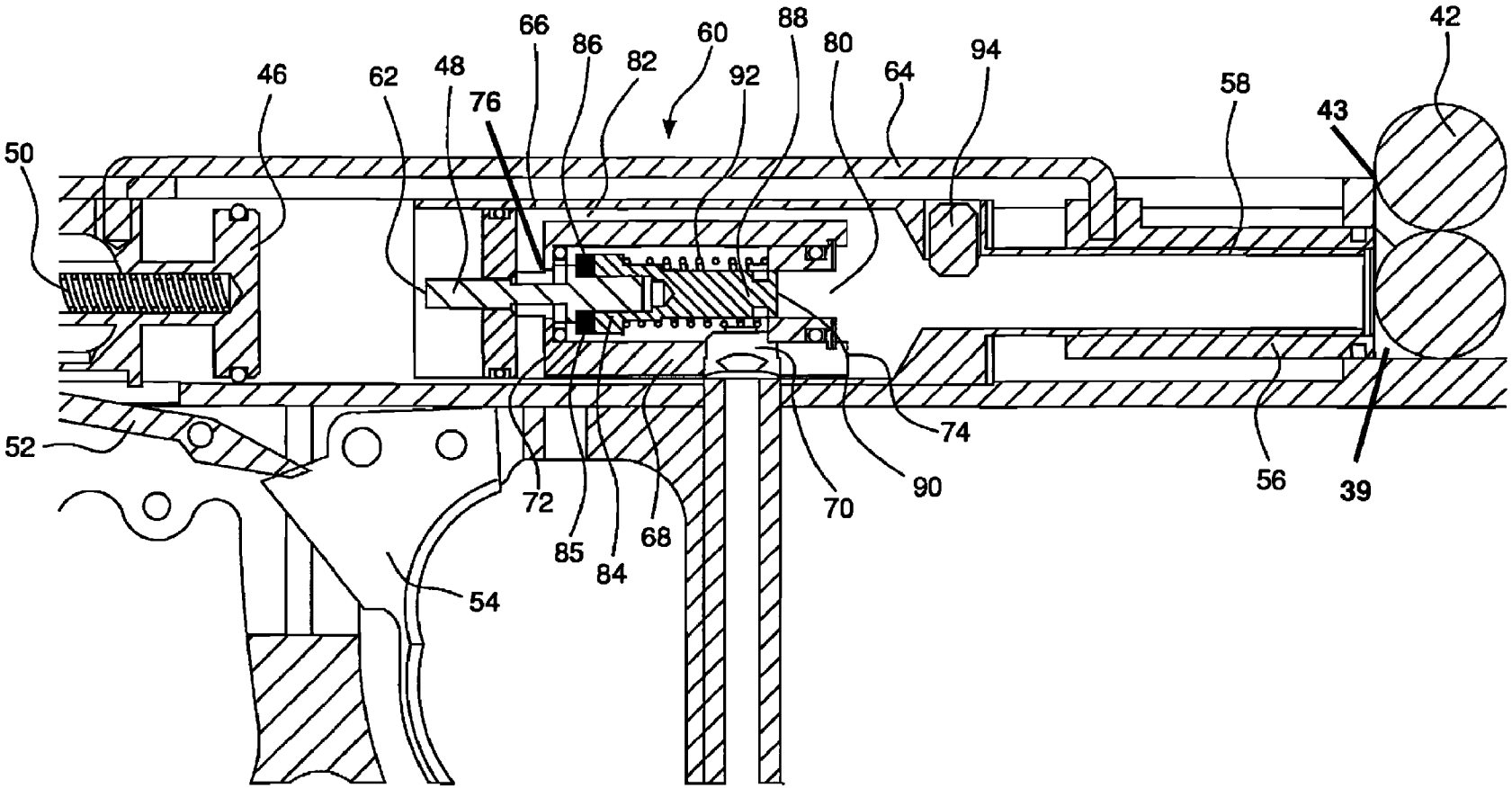
FIG. 3 is a detailed view of the self-regulating valve assembly of FIG. 2.
Figure 5:
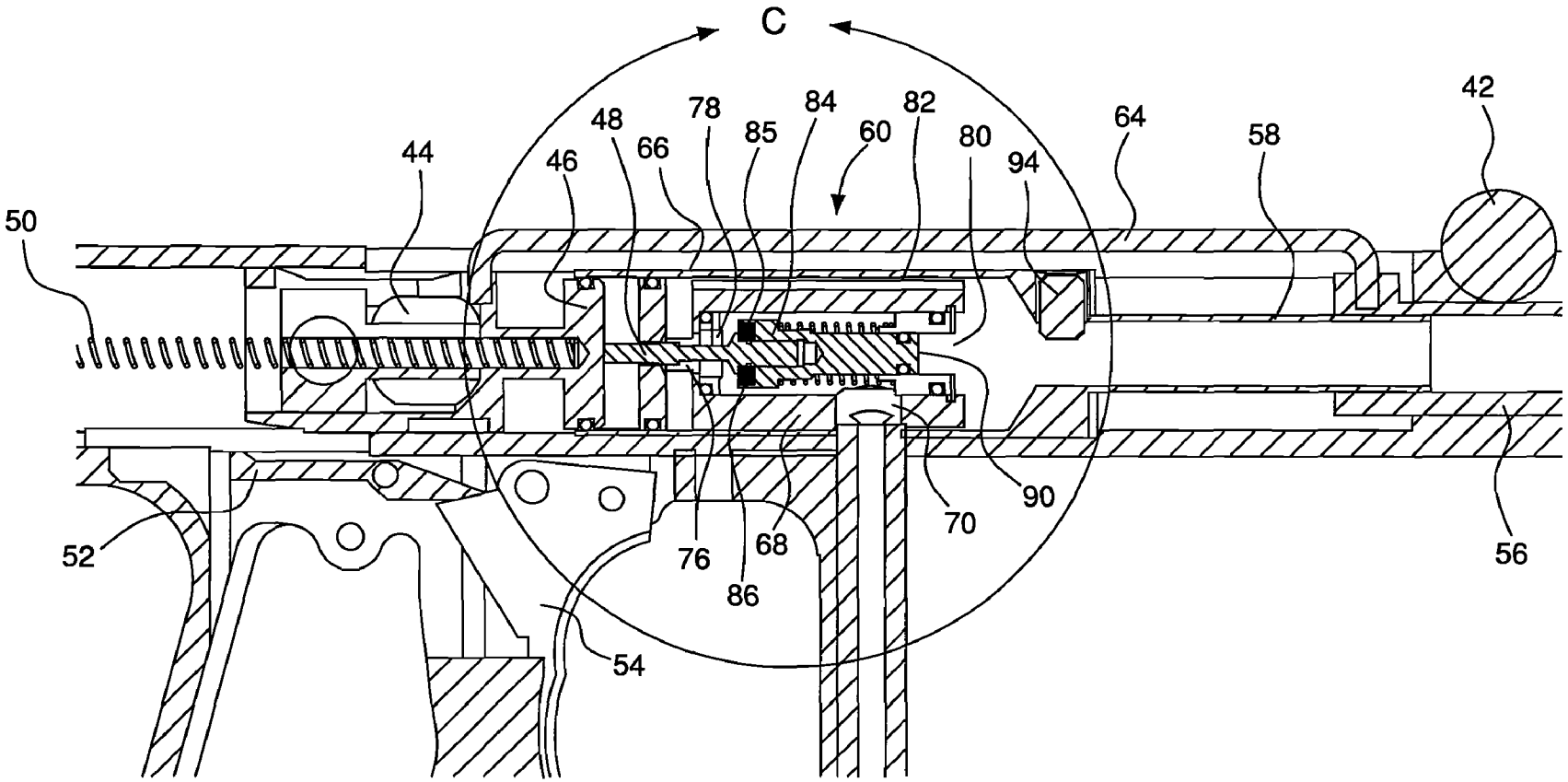
FIG. 5 is a detailed view of the self-regulating valve assembly of FIG. 4, along the cut-out labeled "C"
Figure 6:
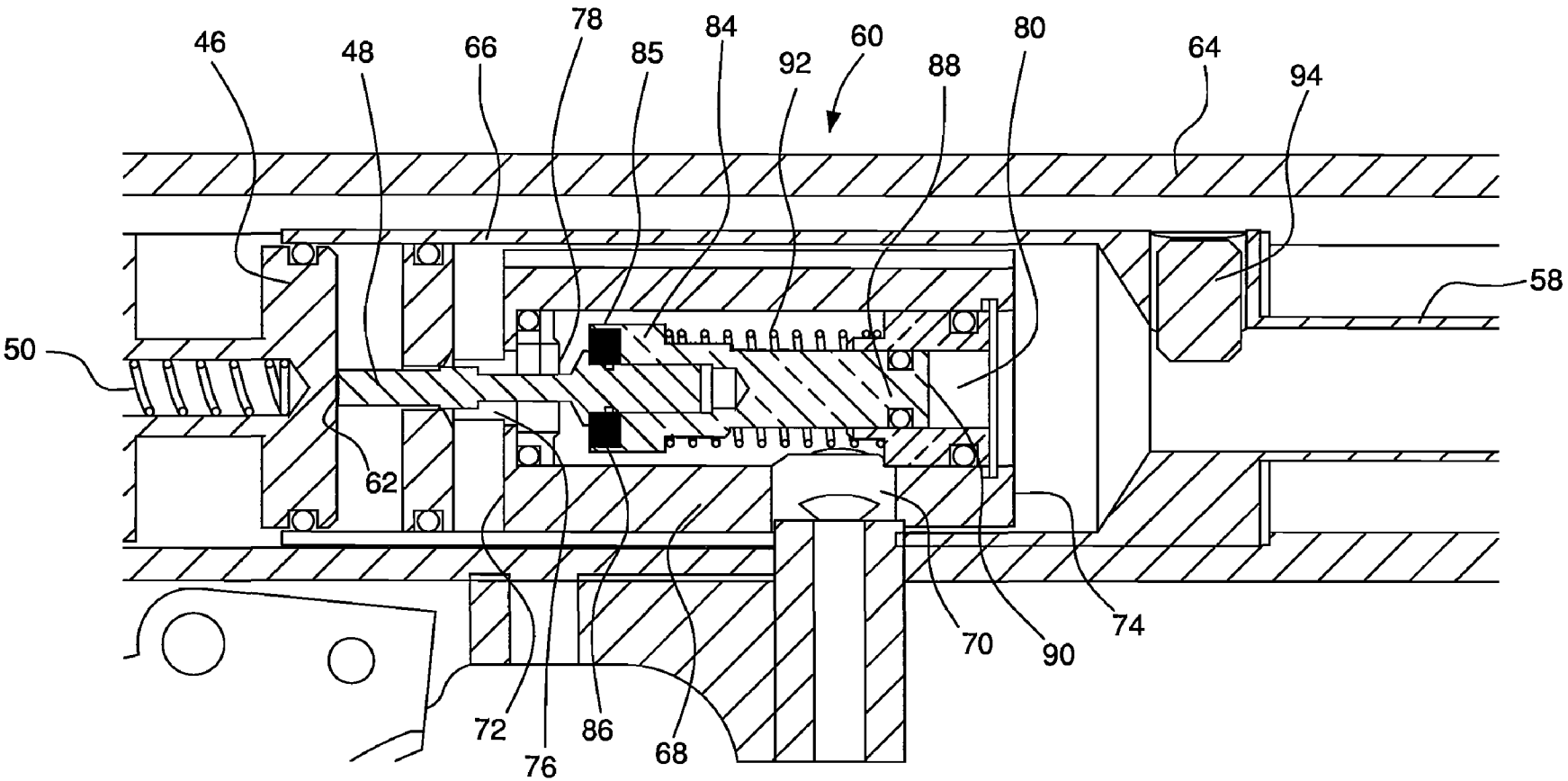
FIG. 6 is a further detail view of the self-regulating valve assembly of FIG. 5.

As illustrated in FIGS. 3, 5, and 6, the self-regulating valve 60 assembly includes a valve housing 66 and a valve body 68 disposed within the valve housing 66. The valve body 68 includes an inlet port 70 for receiving gas under pressure from a compressed gas source and has a rearward end 72 and a forward end 74. The rearward end 72 includes an outlet port 76 for communicating gas under pressure from within the valve body 68 when the valve 60 is actuated or open. A seat 78 (represented in detail in FIGS. 5 and 6) is provided adjacent the outlet port 76. The forward end 74 of the valve body 68 includes a gas balance reservoir 80 open to and in communication with the firing tube 58. At least one valve gas passage 82 (represented in detail in FIGS. 3 and 5) is provided between the valve body 68 and the valve housing 66, the valve gas passage 82 providing communication between the outlet port 76 of the valve body 68 and the gas balance reservoir 80 of the valve body 68. In addition, the valve gas passage 82 provides communication between the outlet port 76 of the valve body 68 and the firing tube 58, so that gas released from the self-regulating valve 60 through the outlet port 76 passes to both the gas balance reservoir 80 of the valve body 68 and to the firing tube 58 to fire a projectile 42 from the gun 30.

A valve poppet 84 is disposed within the valve body 68 and includes a sealing end 85 for contact with the seat 78 of the valve body 68 in a closed position of the self-regulating valve 60, as shown in FIGS. 2 and 3. A sealing member such as a cup seal 86 (labeled in FIGS. 3, 5, and 6) is provided at the sealing end 85 of the valve poppet 84 to assist in preventing the passage of gas from the inlet port 70 of the valve body 68 to the valve gas passage 82 when the self-regulating valve 60 is in the closed position. An o-ring may also be used in addition to the cup seal 86. The valve poppet 84 further includes a sensing end 88 adjacent the gas balance reservoir 80, the sensing end 88 having a sensing face 90 (represented most clearly in FIGS. 3, 5, and 6) preferably facing the forward end 38 of the gun 30 and adapted to react to gas pressure within the gas balance reservoir 80, as described below. The sensing end 88 of the valve poppet 84 is free to move from a rearward position (as shown in FIG. 3) to a forward or firing position (as shown in FIG. 6) within the gas balance reservoir 80. The sensing end 88 may be fitting with an o-ring to assist in keeping compressed gas from passing from within the valve body 68 to the gas balance reservoir 80.

The effective surface area of the valve poppet 84 upon which compressed gas acts (e.g., the surface area facing forwardly in the exemplary Figures) within the valve body 68 is reduced as compared to prior art valves. Notably, at least a portion of the sensing end 88 of the valve poppet 84, and specifically the sensing face 90, is effectively "outside" of the valve body 68, and is freely moveable within the gas balance reservoir 80. Therefore, the sensing face 90 portion of the valve poppet 84, which in a prior art arrangement would be a forwardly facing portion of a cup seal within the valve body, does not contribute to the effective surface area upon which the compressed gas acts within the valve body 68 keeping the seal 86 closed. This reduces the force of the compressed gas on the valve body 68, and in particular, the force on the seal 86.

The valve poppet 84 is slidable between a closed position (FIGS. 2 and 3) and an open position (FIG. 4-6). A valve spring 92 is disposed within the valve body 68, the valve spring 92 biasing the valve poppet 84 toward the closed position, as shown in FIGS. 2 and 3. A lateral screw 94 for adjusting the velocity of gas within the firing tube 58 protrudes as shown in 3, 5, and 6.

In the ready-to-fire state of the gas gun 30, the pressure within the gas balance reservoir 80 and the firing tube 58 is ambient (e.g., to atmosphere), and therefore, the sensing end 88 of the valve poppet 84 does not have increased pressure exerted against the sensing face 90. Thus, in this ready-to-fire state, pressure within the valve body 68 on the valve poppet 84 will be reduced as compared to known valves, as the effective surface against which compressed gas can act (e.g., the surfaces of the seal 86 facing forwardly in the exemplary arrangement in the Figures) is reduced as compared to prior art valves. The force required to keep the valve poppet 84 sealed is thereby minimized by the arrangement of the present invention, with the primary force exerted on the valve poppet 84 provided through the bias of the valve spring 92. The arrangement of the present invention provides for a valve 60 where minimal pressure is need on the stem 48 of the valve poppet 84 when firing.

A source of compressed gas, such as a $CO_2$ or $NO_2$ canister ("gas tank" or "air tank") (not shown), is hooked to an air intake portion 31 of the gun 30, shown beneath the grip 36, and supplies gas under pressure through the inlet port 70 to pressurize the confined area within the valve body 68.

In use, actuation of the trigger 54 disengages the sear 52 from the hammer 44, allowing the hammer 44 to spring forward under the bias of the main hammer spring 50, as shown in FIG. 4. It is appreciated that the trigger and sear arrangement can be of any arrangement known in the art, whether mechanically, electrically or electronically operated. Release of the main hammer spring 50 urges the forward end 46 of the hammer 44 to its forward position to contact the contact end 62 of the valve pin 48 and shift the self-regulating valve 60 from a closed position (FIGS. 2 and 3) to an open position (FIGS. 4-6). The forward movement of the hammer 44 causes synchronized forward movement of the bolt 56 via the connecting rod 64. The forward movement of the bolt 56, in turn, causes forward movement and loading of the projectile 42 in the breech 39, chambering a projectile 42, as shown in FIG. 4.

In the open (or firing) position of the self-regulating valve 60, the cup seal 86 is unseated from the seat 78 of the outlet port 76, releasing the compressed gas supplied within the valve body 68 through the inlet port 70. The gas travels through the outlet port 76 (in a rearward direction in the exemplary shown in the Figures), around a portion of the valve body 68, and through the valve gas passage 82 (in a forward direction in the exemplary shown in the Figures). The gas under pressure then flows into the gas balance reservoir 80 and through the firing tube 58. Pressure from the compressed gas in the firing tube 58 increases to a level at which a projectile 42 chambered in the gas gun 30 is fired down the barrel 40 and from the gun 30.

As gas flows through the valve gas passage 82, prior to the projectile 42 being fired, the area of the gas balance reservoir 80 and through the firing tube 58 rearward of the projectile 42 will experience an increase in pressure. This increased pressure will act on the sensing face 90 of the sensing end 88 of the valve poppet 84. In this manner, when the valve 60 is opened for firing (such as when the hammer 44 strikes the stem 48), some of the gas pressure will act on the sensing face 90 of the sensing end 88 of the valve poppet 84 to assist in closing the valve poppet 84 (e.g., biasing the valve poppet 84 rearward to close the valve 60).

Because there is a minimized force holding the valve poppet 84 closed in the ready-to-fire state, a relatively light hammer 44 and main hammer spring 50 can be utilized to control opening of the valve poppet 84. Use of the configuration of the present invention as a replacement for certain conventional valve assemblies (e.g., Nelson-style), would provide an improved way in which the valve of a compressed gas gun is able to compensate for increased or decreased pressure in the valve chamber or within the gun body. The sensing face 90 of the valve poppet 84 of the self-regulating valve 60 acts to balance the amount of force holding the valve poppet 84 closed. In the ready-to-fire state, the sensing face 90 is open to ambient pressure. During a firing operation, gas under pressure acts within the gas balance reservoir 80 against the sensing face 90 to provide assistance to the valve spring 92 in closing the self-regulating valve 60.

The sensing face 90 of the valve poppet 84 regulates the amount of time the self-regulating valve 60 is open. As explained above, the hammer 44 strikes the valve pin 48, thereby opening the valve poppet 84, and compressed gas travels around the valve body 68 through the valve gas passage 82 toward the firing tube 58. As the gas balance reservoir 80 receives gas under pressure, the gas exerts a force on the sensing face 90 of the valve poppet 84, helping (in conjunction with the bias of the valve spring 92) to shift the valve poppet 84 to its closed position (rearward in the exemplary Figures). The higher the pressure, the more quickly the self-regulating valve 60 will close. Conversely, the lower the pressure, the more slowly the self-regulating valve 60 will close.

The self-regulating valve 60, in essence, acts as a balanced piston regulator, sensing the pressure build-up directly behind the projectile 42. In this manner, the self-regulating valve 60 can adjust to paintballs 42 that fit tightly within the breech 39 and require a shorter burst of gas to propel the paintball 42. Furthermore, the self-regulating valve 60 can adjust to higher or lower input pressures.

The valve housing 66 may include a velocity adjusting screw 94 extending through the body of the gun 30. This screw 94 is accessible to a user. Through adjustment of the velocity adjusting screw 94, the user can regulate the amount of gas flow from the valve gas passage 82 into the firing tube 58, thereby adjusting the velocity of a projectile 42 fired from the gas gun 30.

Advantages of the self-regulating valve 60 of the present invention include, among other things, the ability to use a lighter hammer 44 (about 60% lighter than conventional hammers), a lighter main hammer spring 50, and a lighter trigger 54 pull (due to the lighter main hammer spring 50). A paintball marker gun 30 utilizing the self-regulating valve 60 will have less likelihood to "chop" projectiles such as paintballs due to the lighter main hammer spring 50, and will produce less kick due to the lighter hammer 44 and lighter main hammer spring 50. Less air is required to re-cock (such as through "blow-back") the marker 30 due to the lighter hammer 44 and lighter main hammer spring 50. A stable velocity of compressed gas used for firing a projectile is achieved due to the self-regulating nature of the self-regulating valve 60. Furthermore, the self-regulating valve 60 of the present invention can operate using $CO_2$ or compressed gas without the need for regulators or expansion chambers. The self-regulating valve 60 of the present invention itself can act to regulate gas pressures and valve operation.

It is appreciated that the self-regulating valve 60 of the present invention can be used to replace valves used in variously arranged compressed gas guns. For example, U.S. Pat. No. 7,159,585 ("Firing Assembly for Compressed Gas Operated Launching Device"), the entire contents of which is incorporated by reference herein, shows both a closed bolt and a "stacked tube" or "over/under" operating compressed gas gun using a poppet valve. The hammer of U.S. Pat. No. 7,159,585 is operated by compressed gas, rather than a hammer spring. The self-regulating valve 60 of the present invention could be used as a replacement for the poppet valve shown in U.S. Pat. No. 7,159,585, allowing for a lighter hammer, and decreased gas pressure necessary to move the hammer. The self-regulating valve 60 of the present invention can be used in any compressed gas gun arrangement where a hammer, striker, or ram is utilized, and in any closed-bolt or open-bolt arrangement. Similarly, the self-regulating valve 60 of the present invention can be modified, with different ports, seat and seal arrangements providing for controlled gas flow in various directions.

While the preferred embodiments of the invention have been described in detail above, the invention is not limited to the specific embodiments described which should be considered as merely exemplary. Further modifications and extensions of the present invention may be developed and all such modifications are deemed to be within the scope of the present invention as defined by the appended claims.

What is claimed is:

1. A compressed gas gun comprising:

a gun body comprising a rearward end and a forward end, the gun body including a breech for receiving projectiles;

a bolt disposed within the gun body adjacent the forward end of the gun body, the bolt being slidable from a rearward position to a forward position for chambering a projectile within the breech;

a hammer disposed within the gun body adjacent the rearward end of the gun body, the hammer comprising a forward end, the hammer being slidable from a rearward position to a forward position, the forward end of the hammer adapted to contact a valve pin when the hammer is in its forward position;

a hammer spring disposed within the gun body and biasing the hammer toward the forward position;

a compressed gas source in communication with a valve housing, the compressed gas source supplying compressed gas to a valve body, a valve body disposed within the valve housing, the valve body having an inlet port receiving compressed gas from the compressed gas source and having a rearward end and a forward end the valve body including an outlet port, the forward end including a gas balance reservoir in communication with a portion of the breech of the gas gun;

a valve gas passage providing communication between the outlet port and the gas balance reservoir of the valve body;

a valve poppet disposed within the valve body and including a sealing end and a sensing end adjacent to and positioned at least partially within the gas balance reservoir, the sensing end comprising a sensing face in communication with the outlet port and at least a portion of the breech, the valve poppet being slidable between a closed position and an open position; and a valve spring disposed within the valve body, the valve spring biasing the valve poppet toward the closed position, wherein the gas balance reservoir is not in communication with the compressed gas source when the valve poppet is in the closed position.

2. The compressed gas gun of claim 1, further comprising a connecting rod providing a mechanical linkage between the hammer and the bolt for synchronized movement of the hammer and the bolt.

3. The compressed gas gun of claim 1, wherein the gas balance reservoir has ambient pressure when the valve poppet is in a closed position.

4. The compressed gas gun of claim 1, wherein the sealing end of the valve poppet comprises a cup seal to prevent the passage of gas from the inlet port of the valve body to the valve gas passage in the closed position.

5. The compressed gas gun of claim 1, wherein the sensing face is in communication with the gas balance reservoir.

6. The compressed gas gun of claim 1, wherein the sensing face is in communication with an ambient pressure when the valve poppet is in the closed position.

7. A compressed gas gun comprising:

a gun body comprising a rearward end and a forward end, the gun body including a breech for receiving projectiles;

a bolt disposed within the gun body, the bolt being slidable from a rearward position to a forward position for chambering a projectile within the breech;

a hammer affixed to the bolt and disposed within the gun body, the hammer comprising a forward end and being slidable with the bolt from a rearward position to a forward position, the forward end of the hammer adapted to contact a valve projection when the hammer is in its forward position;

a compressed gas source supplying compressed gas to an inlet port, an inlet port that receives compressed gas from the compressed gas source during firing of the gun;

an outlet port in communication with the breech of the gun that receives the compressed gas after passage through the inlet port;

a gas balance reservoir located within the gun body and positioned such that the compressed gas passes by the gas balance reservoir during firing of the gun, causing an increase in pressure in the gas balance reservoir;

a valve that closes the outlet port, the valve comprising a valve seat and a valve poppet including a sealing end for sealing engagement with the valve seat, the valve poppet being slidable between an open position and a closed position that seals the outlet port, and a spring that biases the poppet towards the closed position; and a sensing portion associated with the valve poppet and positioned at least partially within the gas balance reservoir, the sensing portion including a sensing face that is not in communication with compressed gas from the valve when the valve poppet is in a closed position.

8. The compressed gas gun of claim 7, wherein the sensing face is exposed to ambient pressure when the valve poppet is in the closed position.

9. A compressed gas gun comprising:

a gun body comprising a rearward end and a forward end, the gun body including a breech for receiving projectiles;

a bolt disposed within the gun body adjacent the forward end of the gun body, the bolt being slidable from a rearward position to a forward position for chambering a projectile within the breech;

a hammer disposed within the gun body adjacent the rearward end of the gun body, the hammer comprising a forward end, the hammer slidable from a rearward position to a forward position, the forward end of the hammer adapted to contact a valve poppet when the hammer is in its forward position;

a compressed gas source connected to the gun body and supplying compressed gas to a valve body, the compressed gas exerting a pressure force within the valve body;

a valve housing;

a valve body having a rearward end and a forward end disposed within the valve housing, the valve body having an interior portion, an inlet port for receiving compressed gas from a compressed gas source, and a selectively openable outlet port, the forward end of the valve body including a gas balance reservoir formed as a passage between the interior of the valve body and the exterior of the valve body;

a valve gas passage providing communication between the outlet port and the gas balance reservoir;

a valve poppet disposed within the valve body, the valve poppet being slidable between a closed position retaining compressed gas from the compressed gas source within the interior of the valve body, and an open position releasing compressed gas through the outlet port, the valve poppet including a sensing portion positioned at least partially within the gas balance reservoir, the sensing portion comprising a sensing face extending outside of the interior of the valve body, wherein the sensing face is not in communication with compressed gas from the compressed gas source when the valve poppet is in the closed position, wherein the movement of the valve poppet controls communication of compressed gas to the sensing face.

10. The compressed gas gun of claim 9, wherein the sensing face is exposed to ambient pressure when the valve poppet is in the closed position.

* * * * *